US005887904A

United States Patent [19]

Petkovsek

[11] Patent Number: 5,887,904

[45] **Date of Patent: *Mar. 30, 1999**

[54] INTEGRAL SPECIAL SERVICE MAILING ASSEMBLY WITH A FROZEN LABEL PORTION AND A METHOD FOR USING SAME

[76] Inventor: Glenn Petkovsek, 20 Tortoise Park Cove, Little Rock, Ark. 72211-2349

[ * ] Notice: The portion of the term of this patent subsequent to Dec. 16, 2014, has been disclaimed.

[21] Appl. No.: 730,143

[22] Filed: Oct. 15, 1996

Related U.S. Application Data

[63] Continuation-in-part of Ser. No. 587,585, Jan. 17, 1996, Pat. No. 5,746,450, which is a continuation-in-part of Ser. No. 425,578, Apr. 20, 1995, Pat. No. 5,697,648.

[51] Int. Cl.[6] ..... B42D 15/00

[52] U.S. Cl. ..... 283/61; 281/2; 281/5; 462/8; 462/65; 283/79; 283/81

[58] Field of Search ..... 283/61, 81, 116, 283/79, 101, 103; 462/6–8, 64, 65, 26; 281/2, 5

[56] References Cited

U.S. PATENT DOCUMENTS 4,418,865 12/1983 Bowen .
4,491,334 1/1985 Dicker .
4,565,317 1/1986 Kranz .
4,682,793 7/1987 Walz .
5,183,203 2/1993 Sanders .
5,190,210 3/1993 Walz .
5,476,420 12/1995 Manning .
5,507,526 4/1996 Petkovsek .
5,697,648 12/1997 Petkovsek ..... 283/61
5,746,450 5/1998 Petkovsek ..... 283/61

*Primary Examiner*—Frances Han
*Attorney, Agent, or Firm*—Brian M. Mattison Patents & TMS

[57] ABSTRACT

An assembly for mailing an article requiring delivery by a special service and a method for mailing same are provided. The assembly includes a single sheet constructed in such a way that one portion of the sheet provides a label and the other portion provides a return postcard or other special service form for attachment to an envelope in its assembled position. The sheet includes a backing to which the portions are attached. The backing may include a section that is printable and frozen to the postcard such that the section remains attached to the mailpiece after printing. The return postcard is integrally formed, but removably attached, such that the return postcard remains attached to the envelope until received by the addressee, at which time the return postcard may be removed.

14 Claims, 9 Drawing Sheets

INTEGRAL SPECIAL SERVICE MAILING ASSEMBLY WITH A FROZEN LABEL PORTION AND A METHOD FOR USING SAME

CROSS-REFERENCE

The present invention is a Continuation-in-part of U.S. patent application Ser. No. 08/587,585, filed Jan. 17, 1996, now issued as U.S. Pat. No. 5,746,450 on May 5, 1998 which is a Continuation-in-part of U.S. patent application Ser. No. 08/425,578, filed Apr. 20, 1995, now issued as U.S. Pat. No. 5,697,648 on Dec. 16, 1997.

BACKGROUND OF THE INVENTION

The present invention generally relates to a form for mailing an article requiring special services. More specifically, the present invention relates to an integral special service mailing assembly for mailing an article requiring special services having a return receipt postcard and a label indicative of the special service and a method for using same.

It is, of course, generally known to mail an article requiring special services for delivery of the article, such as certified mail, registered mail, insured mail, COD, return receipt for merchandise and the like. Known components and methods for assembling a mailer for mailing an article requiring special services have multiple, separate components requiring attachment to an exterior of an envelope for the special services delivery of the article.

For example, when a customer of the U.S. Postal Service desires that an article be mailed by certified mail, for instance, an envelope containing the article is provided to the postal employee by the customer. The postal employee is then required to attach or otherwise provide the envelope with a permanent seal or label indicating that the envelope is to be delivered by certified mail.

Then, a return receipt postcard must be attached to the envelope. The postcard must be completed by the postal employee and/or the customer mailing the envelope containing the article. Some postcards include areas having an adhesive for attaching the postcard to the envelope. Other postcards require separate attachment, by using tape, for example.

Such a procedure is both complex and time-consuming, as well as labor intensive. The procedure requires the postal employee to ensure that all of the appropriate labels and documents are affixed to the envelope prior to delivery of the article. Therefore, the appropriate forms, labels and the like must be adequately stocked and available for the postal employee's use. Further, the postal employee must ensure that all articles are appropriately affixed to the envelope. In addition, the return receipt postcard must be suitably affixed to the envelope so that the return postcard is not removed during the mailing of the article to its destination. Of course, it should be understood that an envelope prepared for special service mailing may be prepared by any individual, not just a postal employee.

A need, therefore, exists for an improved integral special service mailing assembly requiring special services, such as certified mail, insured mail, registered mail, COD, return receipt for merchandise and the like, and a method for using same.

SUMMARY OF THE INVENTION

The present invention provides an assembly and a method for using same for mailing an article requiring special services, such as for certified mail, insured mail, registered mail, COD, return receipt for merchandise and the like.

In an embodiment of the present invention, a special service mailing assembly is provided. The assembly has a backing sheet and a sheet removably attached to the backing sheet. The backing sheet has a first section and a second section. The first section including a label is indicative of the special service. The second section includes a form, a first anchor portion and a second anchor portion located at opposite ends of the form. The form is independently detachable from the anchor portions and the label. A portion of the backer is non-removably secured to the sheet.

In an embodiment, a score line is formed between the portion of the backer and the backer to provide removal of the backer without removing the portion.

In an embodiment, a first perforated tear line is formed between the first anchor portion and the form. A second perforated tear line is formed between the second anchor portion and the form wherein the first perforated tear line and the second perforated tear line are constructed and arranged to provide independent detachment of the form.

In an embodiment, the form is a return receipt postcard.

In an embodiment, the label is a certified mail label.

In an embodiment, at least one identifier section has an identifier related to the special service label removably attached to the sheet.

In an embodiment, an adhesive portion is associated with the label.

In an embodiment, a first adhesive portion is located on the first anchor portion, and a second adhesive portion is located on the second anchor portion.

In an embodiment of the invention, an additional form is removably attached to the backing sheet.

In another embodiment of the invention, a method is provided for preparing a mailpiece for special service delivery. The method comprises the steps of: providing a sheet removably attached to a form and a label indicative of a special service required for the mailpiece; removing the form and the label from the sheet wherein at least portions of the sheet and the form are adhesively backed; and attaching the form and the label to the mailpiece.

In an embodiment, the form is a return postcard.

In an embodiment, the form includes a section for receiving bar codes having at least thirty-five characters.

In an embodiment, a portion of the sheet remains attached to the form upon removal of the sheet from the form.

In an embodiment, the special service is certified mail.

It is, therefore, an advantage of the present invention to provide an improved assembly for mailing an article requiring special service.

Another advantage of the present invention is to provide a simplified method for mailing an article requiring special services.

And, another advantage of the present invention is to provide an assembly that is integrally formed as a complete unit for mailing and labeling of an article requiring special services.

Yet another advantage of the present invention is to provide an assembly and a method for mailing an article requiring special services without requiring additional adhesives or fixatives for attaching the same to the mailpiece.

Moreover, an advantage of the present invention is to provide an assembly and a method for mailing an article requiring special services that is substantially foolproof.

Yet, a further advantage of the present invention is to provide an assembly which will work on automated printing equipment.

And, another advantage of the present invention is to provide an assembly including a label and a form that provides for pre-imaging or pre-printing of variable information thereon.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an integral special service mailing assembly for mailing an article requiring special services. Further, the present invention provides a method for using the assembly for mailing articles requiring special services.

Figure 1:
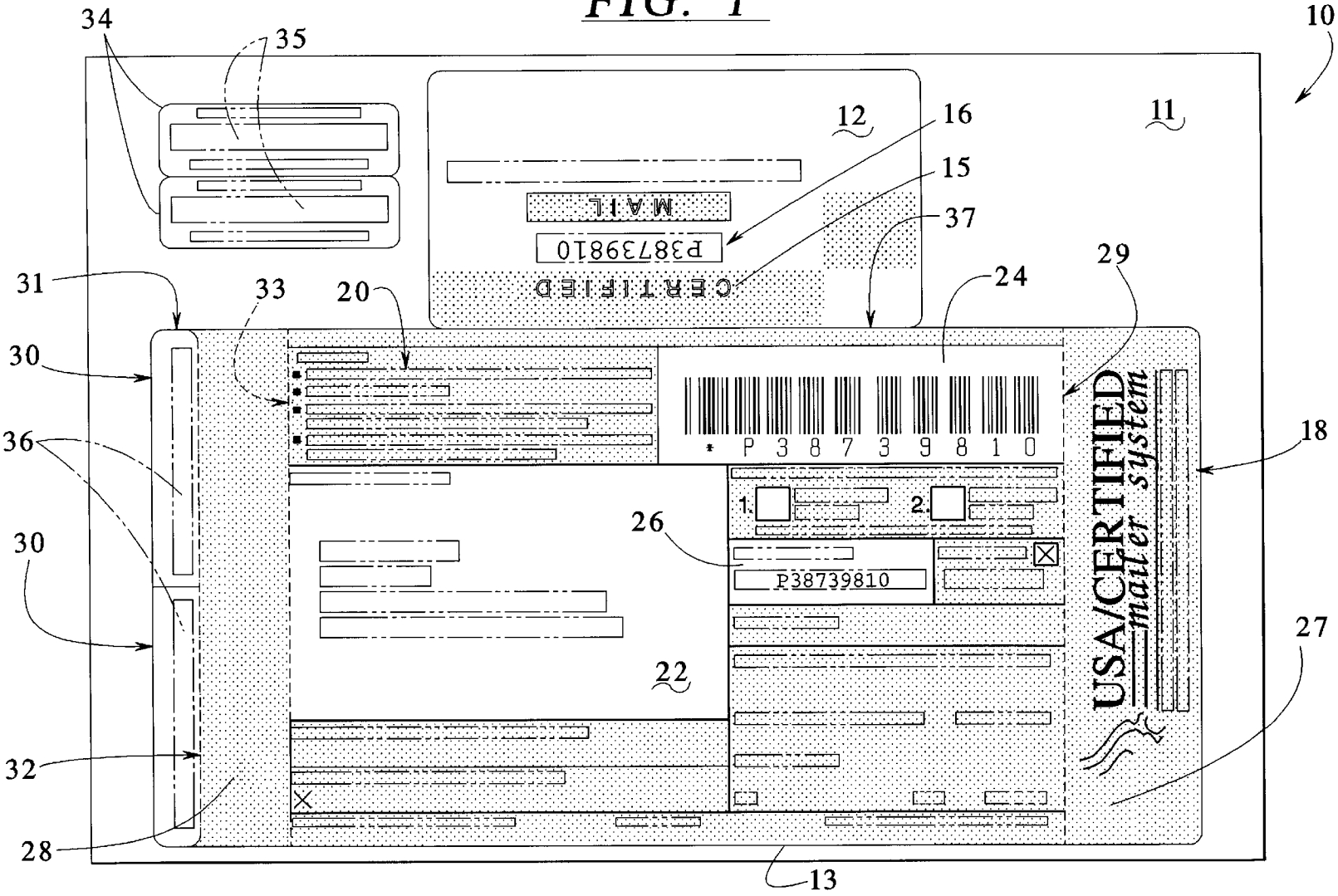
FIG. 1 illustrates a plan view of a front side of an embodiment of an assembly of the present invention.
Figure 4:
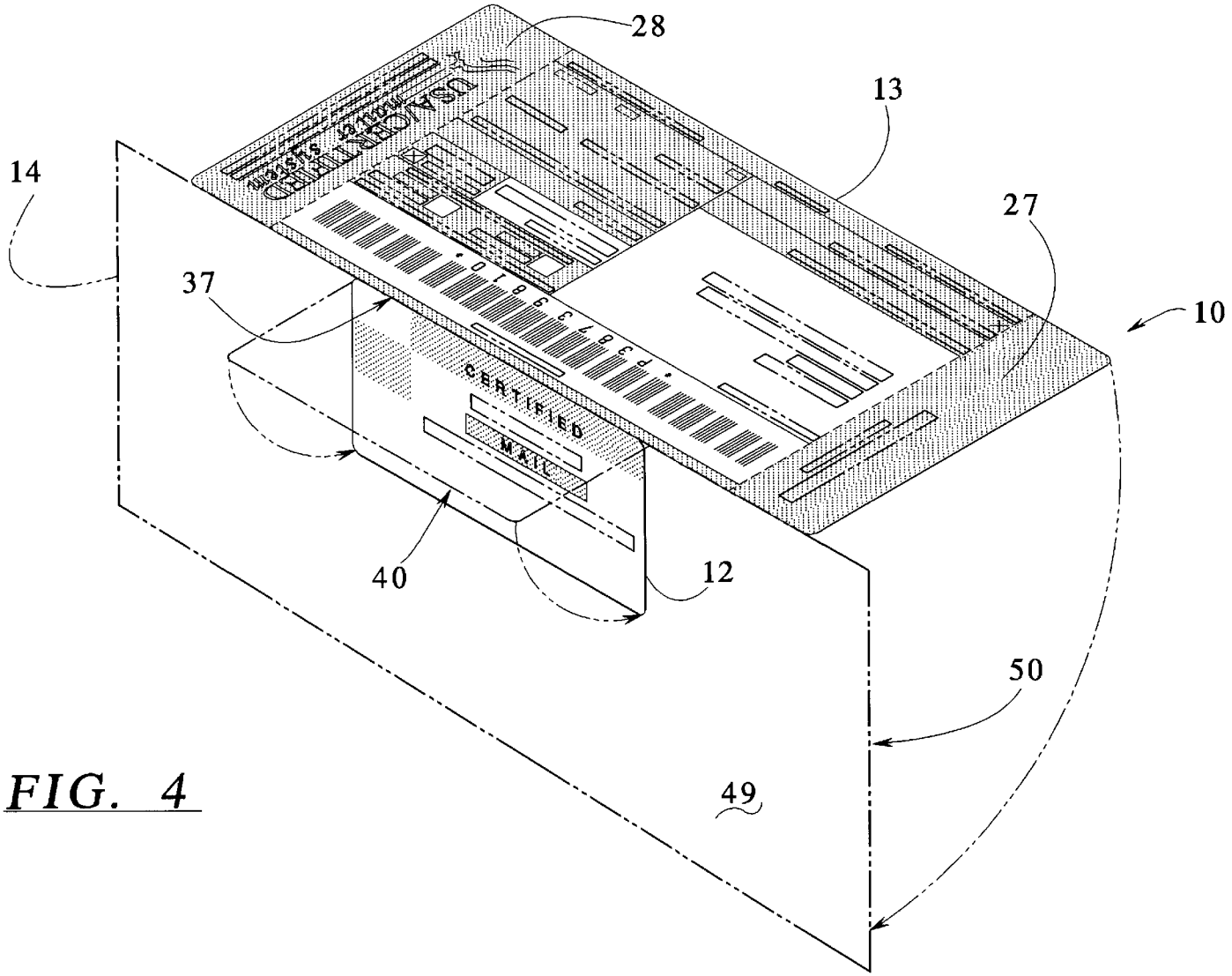
FIG. 4 illustrates a perspective view of a front side of an embodiment of the assembly of the present invention with article to be mailed using same.

Referring now to the drawings, wherein like numerals refer to like parts, FIG. 1 is a front plan view that generally illustrates an embodiment of an assembly 10 formed from a backing sheet 11 having both a label 12 and a return postcard 13. The assembly 10 is capable for use in mailing an article 14 requiring a special service as shown in FIG. 4. Although a certified mail envelope is illustrated, it should be understood that the present invention is applicable to any mailing item requiring special services, such as insured mail, registered mail, COD, return receipt for merchandise and the like.

The front side of the embodiment of the assembly 10 illustrated in FIG. 1 includes the label 12. The label 12 is, in a preferred embodiment, a pre-printed label indicative of the special service required for mailing of the article 14. The label 12 is preferably pre-printed directly on the sheet 11. The pre-printed label 12 includes a special service indicator 15 and a window section 16 in which an article identification number can be printed.

The assembly 10 also has a front bottom portion 18 that includes the return receipt postcard 23 that can be similar to United States Postal Service form PS-3811. The return receipt postcard 13 may include a set of instructions 20 for the sender, as well as an article addressee section 22 for pre-printing the addressee's address. The return receipt postcard 13 also has a document control number bar code 24 to aid in tracking of the article 14.

In addition, the return receipt postcard 13 has a number of sub-sections requiring completion by the sender prior to mailing. One sub-section illustrated at numeral 26 includes a machine readable article identification number corresponding to the number in the window section 16 of the pre-printed label 12. The sub-section 26 may have a background color that contrasts with the color of the return receipt postcard 13 so as to simplify the reading of the machine-readable code in the sub-section 26. Other sections, as well, may include similar color-contrasting portions within the return receipt postcard 13.

Another section of the bottom portion 18 of the assembly 10 is, in a preferred embodiment, a first anchor portion 27 at one end of the return receipt postcard 13 and a second anchor portion 28 at the opposite end. The first anchor portion 27 is separable from the return receipt postcard 13 by means of a perforated tear line 29.

The second anchor portion 28 includes at least one article tracking label 30 provided along a detachable strip 31 at the opposite end of the bottom portion 18 of the assembly 10 and is removable from the bottom portion 18 by a perforated tear line 32. The second anchor portion 28 is also separable from the return receipt postcard 13 by tearing along a perforated tear line 33.

The article tracking label 30 may be adhesively backed for subsequent attachment to a receipt or other item requiring designation of the article number for related purposes. As illustrated, two tracking labels 30 are provided in the embodiment shown. For example, one of the tracking labels 30 may be used by a postal delivery employee on a postal form PS 3849, a delivery notice, (not shown). The second tracking label 30 may be used for the receiver's record use.

In addition, in the embodiment shown, two additional tracking labels 34 are provided. The two additional tracking labels 34, which also include a section 35 for the article identification number, may be used for the sender's records.

The certified article number tracking labels 30 can also be used for the sender's and receiver's record keeping and/or accounting use. Each tracking label 30 has the section 33 for the article identification number. The tracking label 30 may be provided with adhesive on its reverse side. The tracking label 30 may also be a peel and stick type label.

Thus, the bottom portion 18 of the assembly 10 includes three main sections: the return receipt postcard 13 and the first and second anchor portions 27, 28. In addition, the tracking labels 30, 34 are provided. The label 12 is separated from the return receipt postcard 13 by a score line 37 to facilitate separation of the postcard 13 upon delivery of the article 14. As mentioned above, the return receipt postcard 13 has a number of sub-sections requiring completion by the sender prior to mailing the article 14. After delivery of the article 14, the return receipt postcard 13 is detachable from the first and second anchor portions 27, 28 by tearing along the perforated tear lines 29, 33 respectively.

An advantage of the present invention is that a number of the sub-sections of the return postcard 13 and the label 12 discussed above can be pre-printed when the assembly 10 of the present invention is used.

Figure 2:
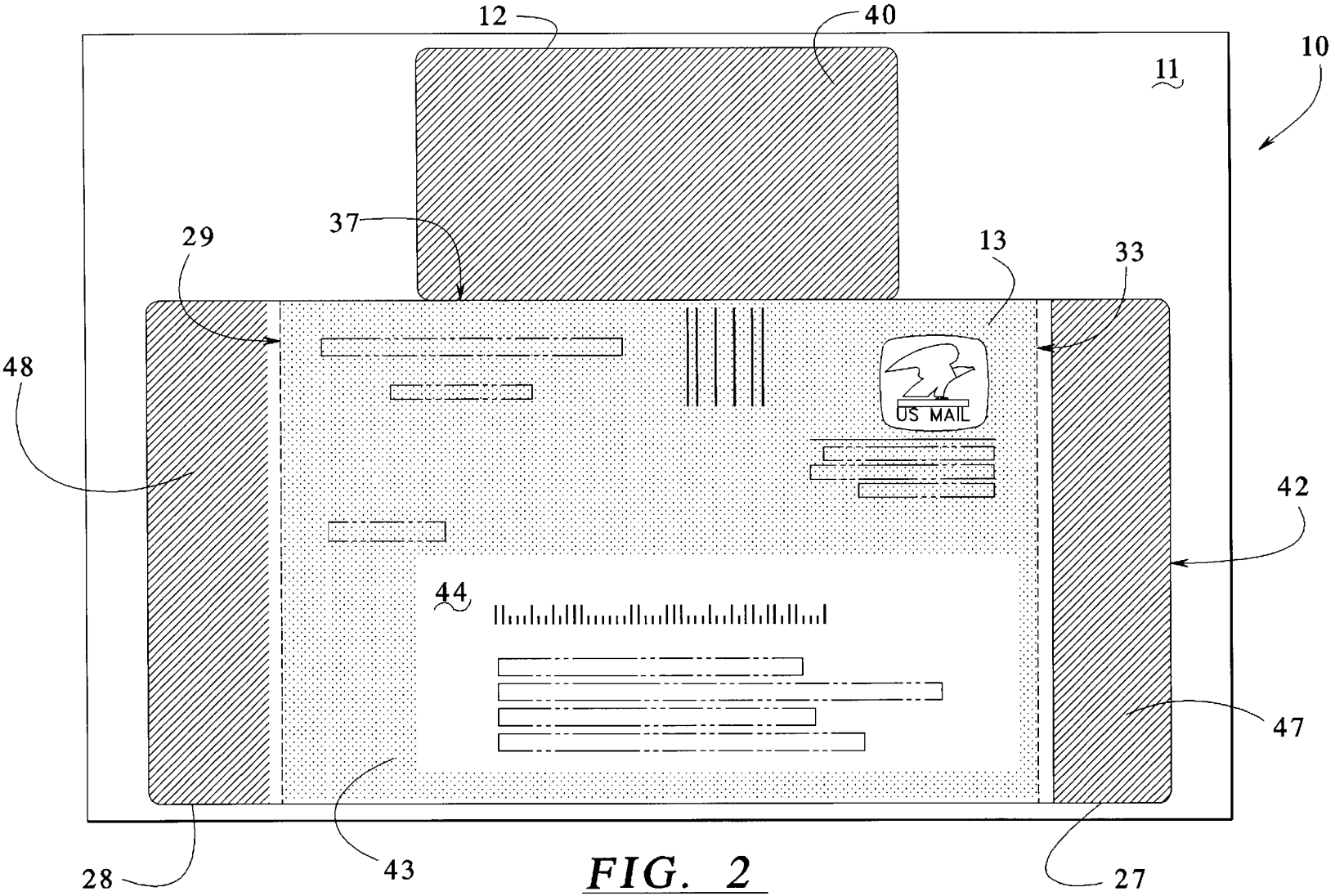
FIG. 2 illustrates a plan view of a back side of an embodiment the assembly of the present invention.

Referring now to FIG. 2, a back plan view of an embodiment of the assembly 10 is illustrated. The reverse side of the label 12 shown in FIG. 1 has an adhesive portion 40. The adhesive portion 40 may be a peel and stick type adhesive and is provided to seal the label 12 to the article 14 requiring special service mailing as shown in FIG. 4.

A back bottom portion 42 of the assembly 10 includes a front side 43 of the return receipt postcard 13. The return receipt postcard 13 includes a "Return To" section 44. The "Return To" section 44 may be color-contrasted with the remainder of the return receipt postcard 13 to enable simplified reading of the "Return To" section 44.

The score line 37 is provided along the top side of the return receipt postcard 13. For subsequent detachment of the return receipt postcard 13, the perforated tear lines 29, 33 are provided along the edges adjacent to the anchor portions 27, 28. The first anchor portion 27 has a first adhesive portion 47 and the second anchor portion 28 has a second adhesive portion 48 to adhere the back bottom portion 42 to the article 14 prior to mailing.

Figure 3:
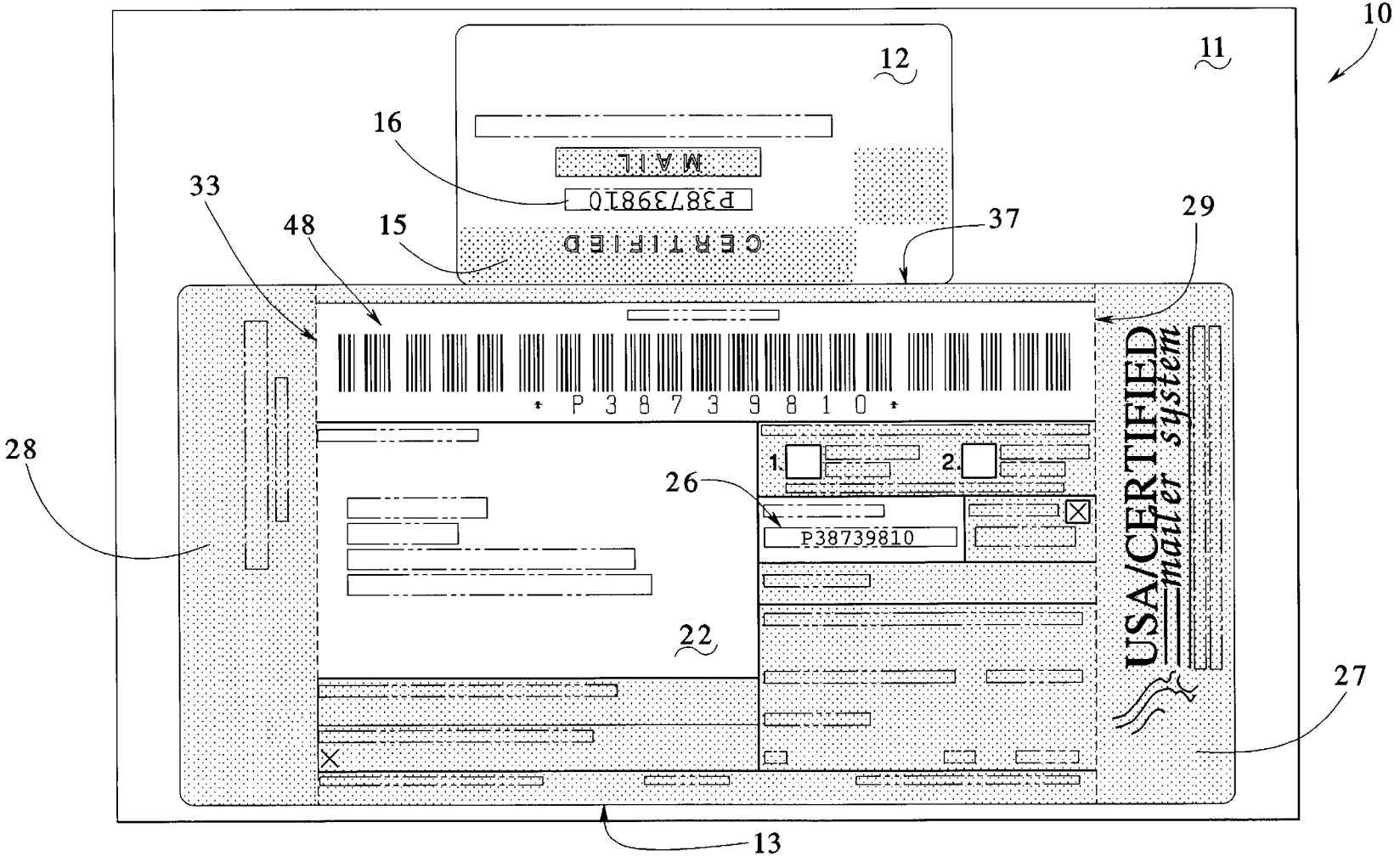
FIG. 3 illustrates a plan view of a front side of another embodiment of the assembly of the present invention.

FIG. 3 shows another embodiment of the assembly 10 of the present invention, wherein like numerals represent like parts. This embodiment is a simplified version of the prior embodiment in that it does not have the instruction section 20 nor does it have the tracking labels 30, 34. However, the embodiment illustrated in FIG. 3 as an enlarged bar code region 48 for easier reading during high speed processing. The embodiment of the present invention illustrated in FIG. 3 is shown in use in FIG. 4.

Referring now to FIG. 4, the article 14 requiring special service, shown from its front side, is shown. The pre-printed label 12 is shown having the window section 16 in which the certified mail number is printed either manually or automatically. As illustrated, the label 12 folds down onto a front side 49 of the article 14 requiring special service mailing. The label 12 is adhered to the front side 49 of the article 14 by means of the adhesive portion 40 located on the back side of the label 12 (see FIG. 2). Also as illustrated in FIG. 4, the bottom portion 18 of the assembly 10, including the anchor portions 27, 28 and the return receipt postcard 13, is sealed to a back side 50 of the article 14 and the anchor portions 27, 28 are sealed to the article 14 by the adhesive portions 47 and 48, respectively. Also, the score line 37 is located at the top of the article 14 to provide for easier subsequent separation of the return receipt postcard 13 from the anchor portions 27, 28 and the label 12 upon delivery of the article 14.

Figure 5:
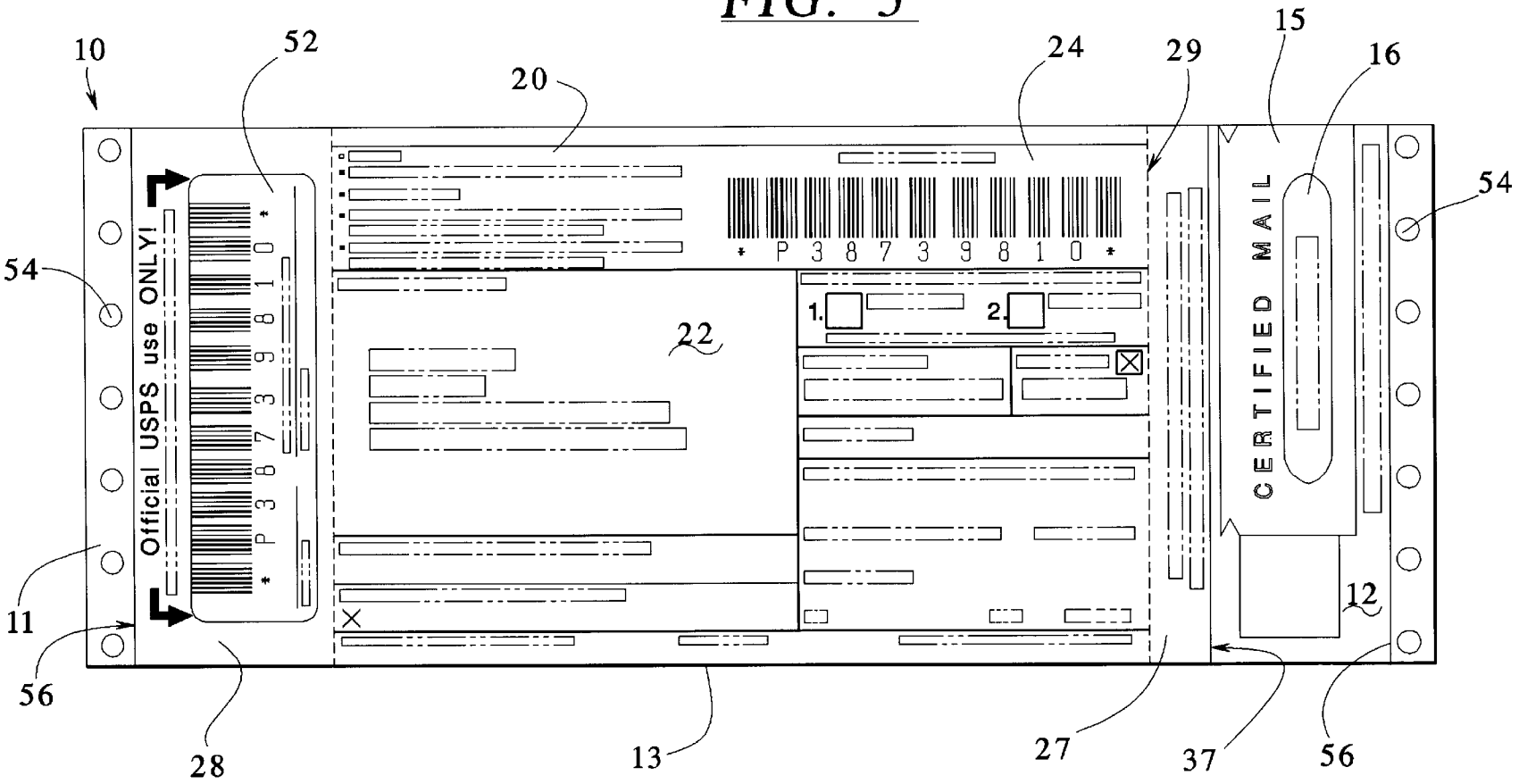
FIG. 5 illustrates a plane view of a front side of another embodiment of the assembly of the present invention.

FIG. 5 illustrates another embodiment of the assembly 10 of the present invention. In the embodiment shown in FIG. 5, the orientation of the label 12 with respect to the postcard 13 is changed. However, like numerals represent like parts and the score line 37 between the label 12 and the postcard 13 is shown located between the label 12 and the return receipt postcard 13. In addition, a tracking indicator 52 is provided on the second anchor portion 28. Another variation in the embodiment shown in FIG. 5 is that the sheet 11 has a plurality of tracker holes on the edges thereof for use in a printer having tracking wheels to advance the paper. The tracking holes 54 are located on a tracking strip 56.

Figure 6:
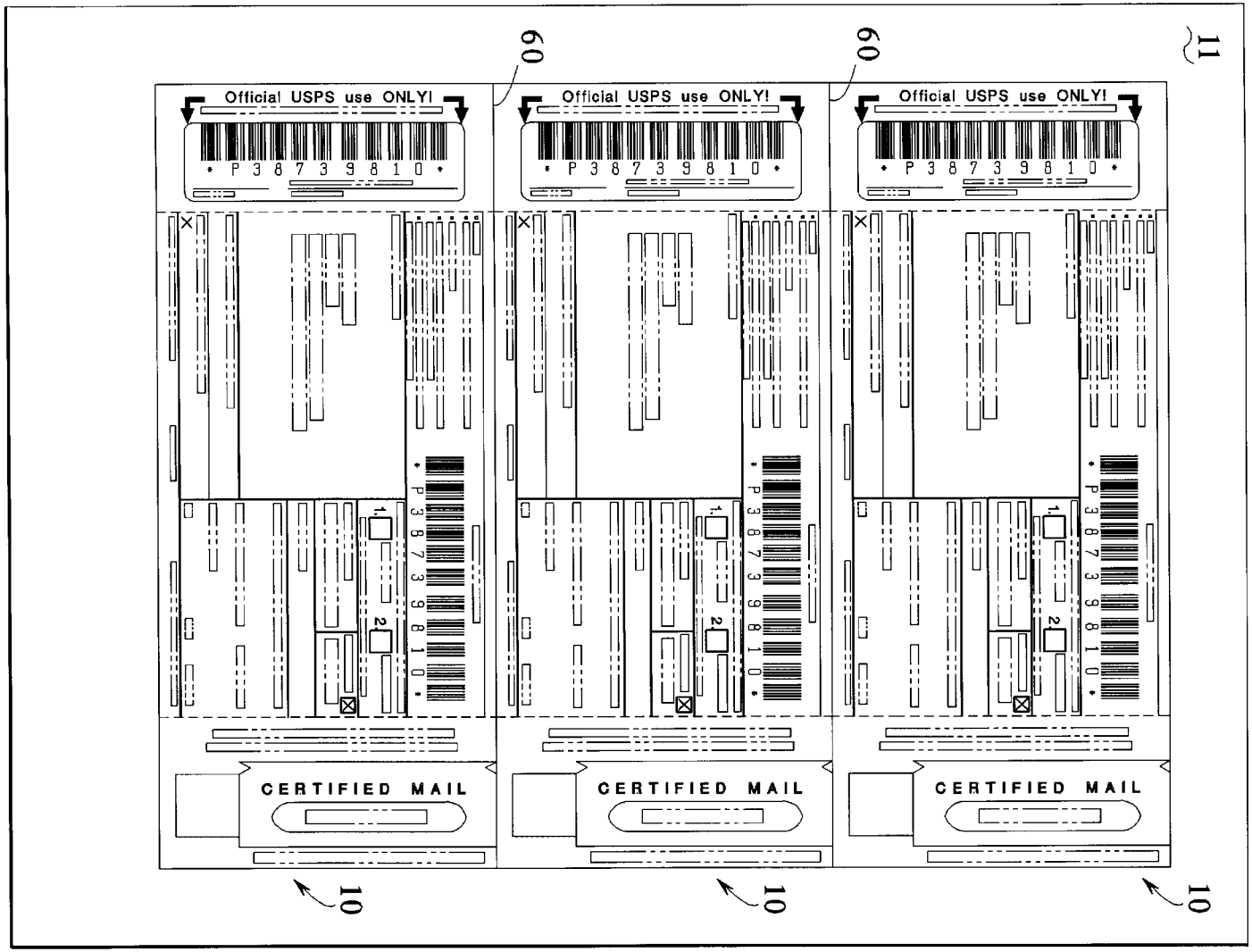
FIG. 6 illustrates another embodiment of the assembly of the present invention in which a plurality of assemblies are located on a single sheet.

In addition, a plurality of the assembly 10 can be provided on a single backing sheet 11 as shown in FIG. 6. Each assembly 10 is separable from the adjacent assembly 10. This can be accomplished by a score line 60. In such a case, it is preferred that the assembly 10 is a lift and stick type assembly that is removably attached to the backing sheet 11. Thus, each individual assembly 10 is detachable from the sheet 11 as needed. Also, the entire assembly may be printed at one time for subsequent separation and application to separate articles 14.

Figure 7:
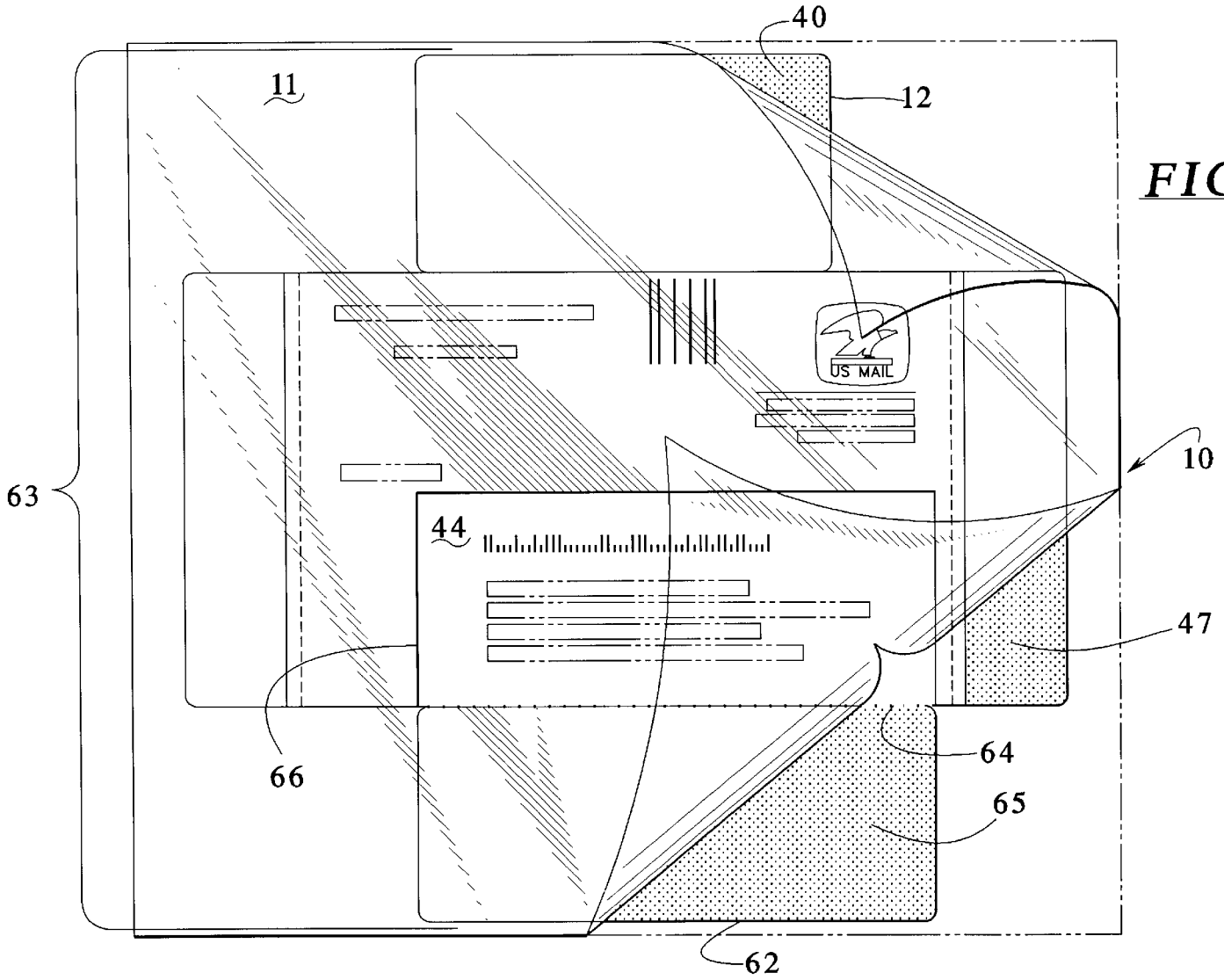
FIG. 7 illustrates a further embodiment of the assembly of the present invention in which a portion of the backing sheet is cut out.

FIG. 7 illustrates a further embodiment of the assembly 10 of the present invention. A back plan view of the embodiment of the assembly 10 is illustrated. The label 12, the postcard 13 and an additional label 62 form a special service mailing sub-assembly 63. The opposite side of the additional label 62 can be pre-printed with an address of the individual to whom the article 14 is being sent. The additional label 62 may also be separable from the postcard 13 of the sub-assembly 63 by a score line 64. The score line 64 may be perforated. In this embodiment, the sub-assembly 63 preferably lifts off the backing sheet 11. FIG. 7 illustrates how the backing sheet 11 is peeled from the remainder of the assembly 10.

To use this embodiment, the backing sheet 11 is peeled from the sub-assembly 63 which exposes the anchor portions 27, 28. Once the backing sheet 11 is peeled away, the adhesives 40, 47 and 48 are exposed. The additional label 62 also has an adhesive 65 for affixing the additional label 62 to the article 14. The sub-assembly 63 and the additional label 62 may be affixed to the article 14 by the adhesives 40, 47, 48 and 65. Thus, when a user completely peels the sheet 11 from the sub-assembly 63, the adhesive portions are exposed for applying the sub-assembly 63 to the article 14 prior to mailing.

A further advantage of the embodiment illustrated in FIG. 7 is that the backing sheet 11 is provided with a cut out portion 66. That is, the backing sheet 11 is non-continuous having at least one section (in this embodiment, the cut out portion 66) that is removed so as to directly expose the sub-assembly 63 (in this case, the "Return to" section 44 of the sub-assembly 63). As illustrated, the cut out portion 66 has a size approximately equal to the "Return To" section 44. The cut out portion 66 exposes the sub-assembly 63 allowing the "Return To" section 44 to be directly printed while the sub-assembly 63 is attached to the backing sheet 11. This also allows both sides of the sub-assembly 63 to be substantially simultaneously printed if desired.

The assembly 10 can be printed using any known method of printing and is not limited to any single type. Such printing methods include, but are not limited to, laser printing, thermal printing, dot matrix printing and the like. Printing may be performed on continuously fed forms or on individually fed forms.

Figure 8:
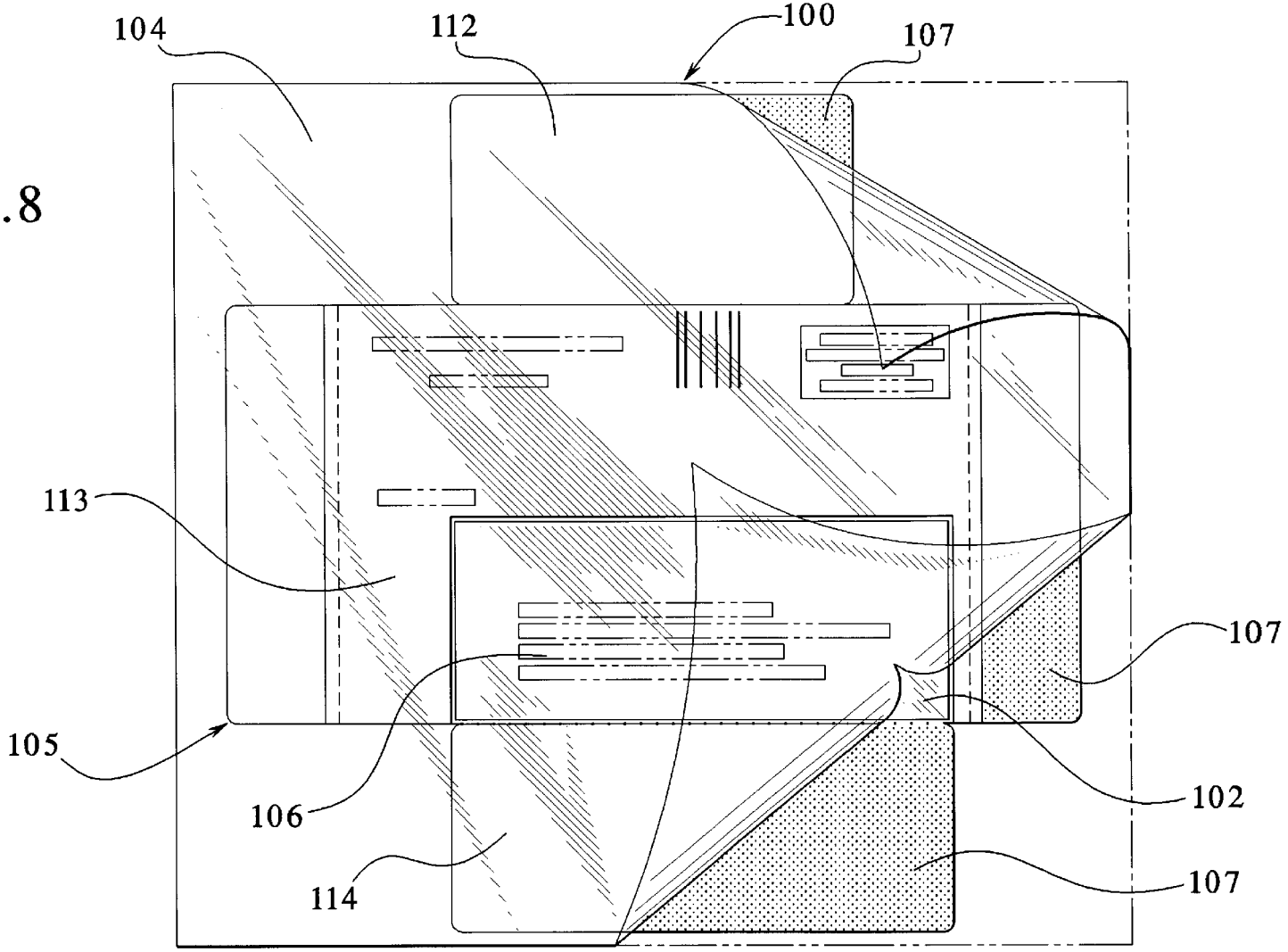
FIG. 8 illustrates a plan view of a still further embodiment of the assembly of the present invention with a printable frozen label area.

FIG. 8 illustrates another embodiment of an assembly 100. The assembly 100 includes a frozen printable area 102 made from a portion of a backer 104 removable from a subassembly 105 of the assembly 100 that includes a label 112, a postcard 113 and an additional form 114. The subassembly 105 is used in a manner identical to that described with reference to FIG. 7; however, the manner in which the subassembly 105 is printed and removal of the backer 104 from the subassembly 105 is distinct from that illustrated in FIG. 7. More specifically, the frozen printable area 102 is scored or otherwise removably separable from the backer 104 so as to remain attached to the postcard 113 of the subassembly 105. The attachment of the frozen printable area 102 is effected by any known means and may be implemented by one having ordinary skill in the art. For example, an adhesive (not sown) may be used to secure the frozen printable area 102 to the postcard 113. After printing an address 106 on the frozen printable area 102 of the backer 104, the backer 104 may be removed from the subassembly 105 without removal of the frozen printable area 102. The combination of the backer 104 with the frozen printable area 102 provides a uniform thickness in the assembly 100 simplifying printing of the same. Adhesive areas of the subassembly 105 are generally designated at 107.

Figure 9:
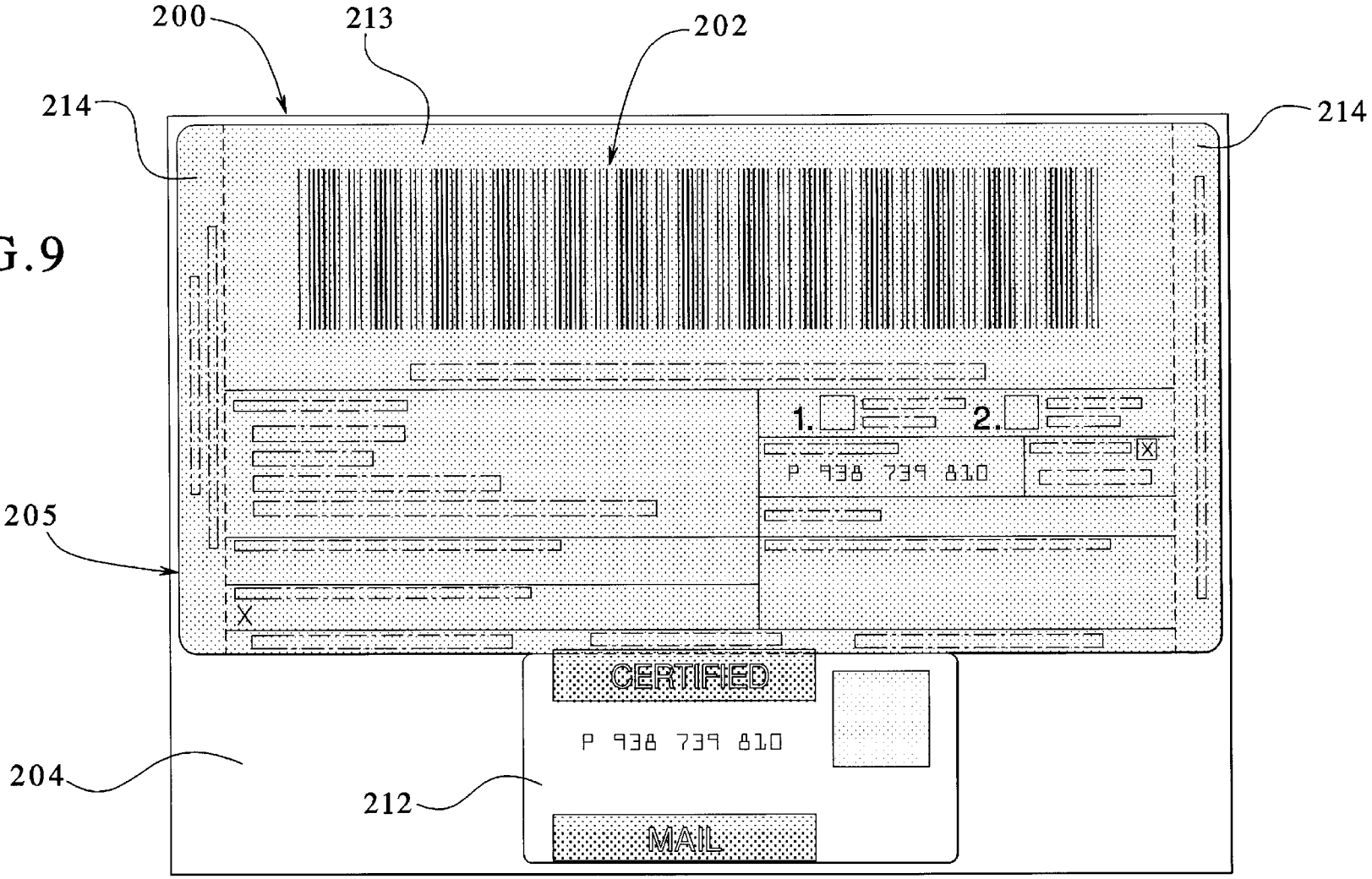
FIG. 9 illustrates a plan view of yet another embodiment of the assembly of the present invention with an enlarged area for machine readable code addressing.

FIG. 9 illustrates another embodiment of an assembly 200 having an enlarged machine readable section 202 on a subassembly 205 of the assembly 200. The subassembly 205 is removably attached to a backer 204. The subassembly 205, as illustrated, includes a postcard 213 and a label 212. The label 212 and exterior portions 214 of the postcard 213 are adhesively backed for attachment to a mailpiece after removal of the subassembly 205 from the backer 204. The enlarged machine readable section 202 provides space for an extended character bar code that may be printed and subsequently read by devices designed to read such coding. Therefore, for specific applications, a maximum amount of information that is machine readable may be placed on a single side of the postcard 213 and, ultimately, the mailpiece following attachment of the subassembly 205 thereon.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A special service mailing assembly comprising:

a backing sheet; and a sheet removably attached to the backing sheet having a first section and a second section, the first section including a label indicative of the special service, and a second section including a form, a first anchor portion and a second anchor portion located at opposite ends of the form, the form being independently detachable from the anchor portions and the label wherein a portion of the backing sheet is non-removably secured to the form.

2. The special service mailing assembly of claim 1 further comprising:

a score line formed between the portion of the backer and the backer to provide removal of the backer without removing the portion.

3. The special service mailing assembly of claim 1 further comprising:

a first perforated tear line formed between the first anchor portion and the form; and a second perforated tear line formed between the second anchor portion and the form, the first perforated tear line and the second perforated tear line constructed and arranged to provide independent detachment of the form.

4. The special service mailing assembly of claim 1 wherein the form is a return receipt postcard.

5. The special service mailing assembly of claim 1 wherein the label is a certified mail label.

6. The special service mailing assembly of claim 1 further comprising:

at least one identifier section having an identifier related to the special service label removably attached to the sheet.

7. The special service mailing assembly of claim 1 further comprising:

an adhesive portion associated with the label.

8. The special service mailing assembly of claim 1 further comprising:

a first adhesive portion located on the first anchor portion and a second adhesive portion located on the second anchor portion.

9. The special service mailing assembly of claim 1 further comprising:

an additional form removably attached to the backing sheet.

10. A method for preparing a mailpiece for special service delivery, the method comprising the steps of:

providing a sheet removably attached to a form and a label indicative of a special service required for delivery of the mailpiece;

removing the form and the label from the sheet wherein at least portions of the form are adhesively backed; and attaching the form and the label to the mailpiece.

11. The method of claim 10 wherein the form is a return postcard.

12. The method of claim 10 wherein the form includes a section for receiving bar codes having at least thirty-five characters.

13. The method of claim 10 wherein a portion of the sheet remains attached to the form upon removal of the sheet from the form.

14. The method of claim 10 wherein the special service is certified mail.

* * * * *